US009555906B1

(12) United States Patent
Worsley et al.

(10) Patent No.: US 9,555,906 B1
(45) Date of Patent: Jan. 31, 2017

(54) CUSTOM BRANDED TAPE IN A MULTI-SELLER ENVIRONMENT

(71) Applicant: Amazon Technologies, Inc., Reno, NV (US)

(72) Inventors: Timothy Craig Worsley, Snoqualmie, WA (US); Karthik Kumar Srivatsa, Bellevue, WA (US); Charles Edward Rice, Bainbridge Island, WA (US); William Alan Snitselaar, Seattle, WA (US); Jeffery Thomas Moore, Seattle, WA (US); Jonathan Eric Rosenberg, Seattle, WA (US); Dean Christopher Fullerton, Seattle, WA (US); David Henry Clark, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 638 days.

(21) Appl. No.: 14/021,533

(22) Filed: Sep. 9, 2013

(51) Int. Cl.
*B65B 7/00* (2006.01)

(52) U.S. Cl.
CPC ..... *B65B 7/00* (2013.01)

(58) Field of Classification Search
None
See application file for complete search history.

(56) References Cited

U.S. PATENT DOCUMENTS

| | | | | |
|---|---|---|---|---|
| 4,683,704 | A * | 8/1987 | Vorachek | B65B 25/14 53/461 |
| 4,809,481 | A * | 3/1989 | Fruh | B65B 65/003 53/452 |
| 6,070,396 | A * | 6/2000 | Rinaldi | B65B 7/20 493/23 |
| 6,668,892 | B2 * | 12/2003 | Vasilakes | B65B 51/067 101/474 |
| 9,174,758 | B1 * | 11/2015 | Rowley | B65B 59/00 |
| 9,406,175 | B2 * | 8/2016 | Sussmeier | B65H 35/0033 |
| 2004/0060264 | A1 * | 4/2004 | Miller | B65B 11/18 53/461 |
| 2008/0264834 | A1 * | 10/2008 | Olsen | B07C 7/005 209/547 |
| 2009/0271295 | A1 * | 10/2009 | Hodge | G06Q 30/0601 705/26.1 |

* cited by examiner

*Primary Examiner* — Timothy Waggoner
*Assistant Examiner* — Stephen Akridge
(74) *Attorney, Agent, or Firm* — Athorus, PLLC

(57) ABSTRACT

The disclosure describes a system for applying custom branded tape to packages that are shipped from a multi-seller materials handling facility. In some implementations, a materials handling facility may store, process and ship items for multiple sellers. As items are packed for shipping, a tape dispensing device may dispense custom branded tape associated with the seller of the item(s) being packed such that the sellers brand, logo or other information is presented on the exterior of the container.

21 Claims, 8 Drawing Sheets

CUSTOM BRANDED TAPE IN A MULTI-SELLER ENVIRONMENT

BACKGROUND

Many companies package items and/or groups of items together for a variety of purposes, such as e-commerce and mail-order companies that package items (e.g., books, CDs, apparel, food, etc.) to be shipped to fulfill orders from customers. Retailers, wholesalers, and other product distributors (which may collectively be referred to as sellers) typically maintain an inventory of various items that may be ordered by clients or customers. This inventory may be maintained and processed at a materials handling facility which may include, but is not limited to, one or more of: warehouses, distribution centers, cross-docking facilities, order fulfillment facilities, packaging facilities, shipping facilities, or other facilities or combinations of facilities for performing one or more functions of material (inventory) handling. Some materials handling facilities may store, process and ship inventory for multiple sellers.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

Figure 1:
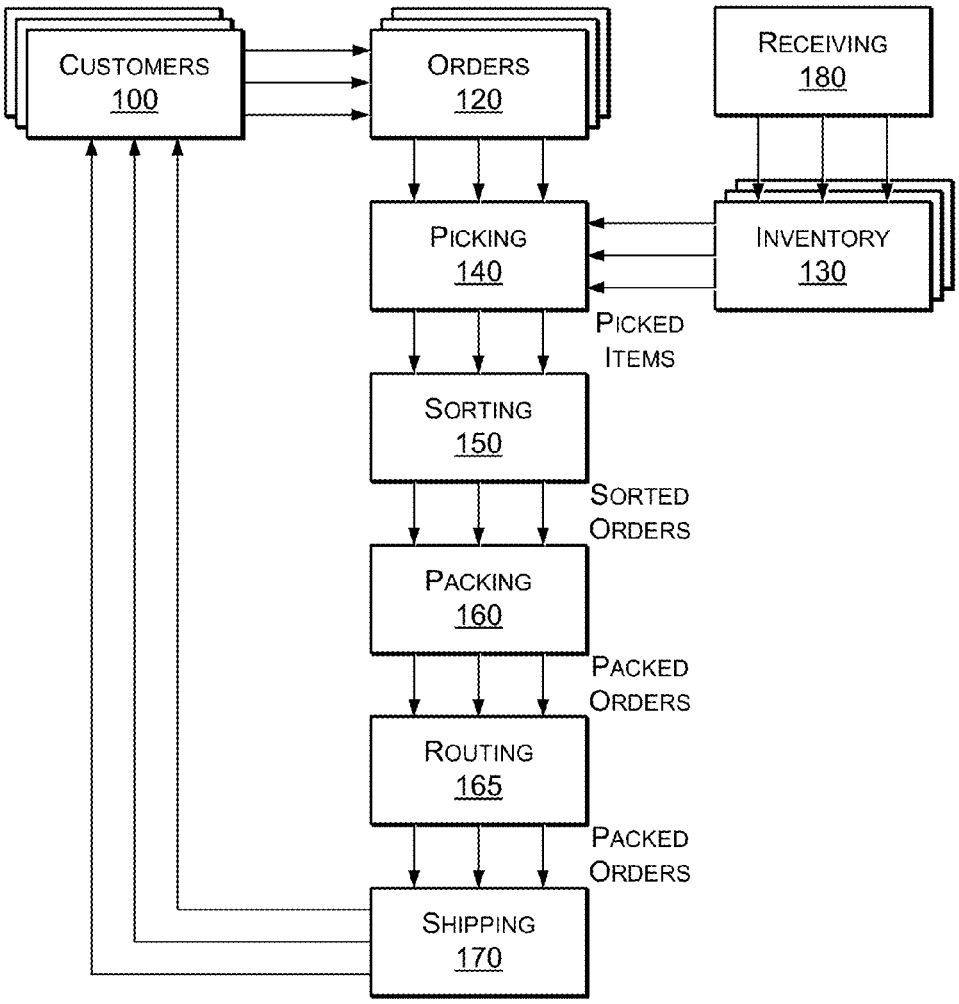
FIG. 1 illustrates a broad view of the operations of a materials handling facility, in one implementation.

While implementations are described herein by way of example, those skilled in the art will recognize that the implementations are not limited to the examples or drawings described. It should be understood that the drawings and detailed description thereto are not intended to limit implementations to the particular form disclosed, but on the contrary, the intention is to cover all modifications, equivalents and alternatives falling within the spirit and scope as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including, but not limited to.

DETAILED DESCRIPTION

A packaging information system configured to facilitate picking, packing and/or shipping operations may include various components used to facilitate efficient and/or cost-effective operations in a materials handling facility. In a materials handling facility that stores, processes and ships items on behalf of multiple different sellers, the packaging information system may include a planning service, a product dimension estimator, a container recommendation service, an item routing service and/or one or more tape dispenser devices configured to dispense custom branded tape for use in securing a container. For example, one or more of these components may be utilized to route an ordered item to a particular pack station within the materials handling facility such that custom branded tape associated with the seller of the item can be applied to the container in which the ordered item will be shipped. Likewise, instructions may be provided to the tape dispenser device to identify which roll of tape is to be dispensed for packing the item and/or how much custom branded tape is to be dispensed for packing the item.

As described in further detail below, the tape dispensing device may be configured to dispense custom branded tape for multiple different sellers. With such a configuration, when an item is ordered the container into which the item is placed may be sealed with custom branded tape that includes the name, logo and/or other identifying information associated with the seller of the item. In some implementations, the seller may select what custom branding they want applied to containers. In other implementations, the customer may be able to select custom branded tape that is applied to the container. In still other implementations, the custom branded tape may be used to apply warning labels (e.g., fragile, heavy, this side up, do not cut, hazardous) to the container.

In some implementations, when an item is ordered the packaging information system may identify the seller of the item and determine if the seller has requested custom branding. If the seller has requested custom branding, the packaging information system may determine which materials handling facility will be used to ship the item and generate fulfillment instructions for that materials handling facility for use in fulfilling the order for the item. The fulfillment instructions may include an identification of the item, a recommended container into which the item is to be placed for shipment, the identification of the seller, whether the container is to receive custom branded tape and/or an identification of the custom branding that is to be applied to the tape. The materials handling facility, upon receiving the fulfillment instructions, may initiate picking of the item from inventory and specify a pack station to which the item is to be delivered so that when packed the container will receive the custom branded tape.

As used herein, the term "item package" may refer to a single item to be stored, shipped, or otherwise handled in a container, alone, or to multiple items that have been grouped for shipping, storing or for any other operations within a materials handling facility, such as for storing in inventory or transporting to a pack or ship station. Items of an item package may be sold or for sale from one or many different sellers. The term "container" may refer to any dimensionally-constrained environment, such as crates, cases, bins, boxes, or any other apparatus capable of storing one or more items. The term "tape" may refer to any physical component used to seal the open seams of containers. For example, tape may be an adhesive tape, such as a water activated tape that is dispensed at a pack station and used to seal the edges of a container together when forming and/or closing the container. The term "transportation unit" may refer to any environment onto or into which items and/or containers may be stored or placed for conveying or transporting. For example, a transportation unit may be a pallet, truck, trolley, trailer, gaylord, partial-gaylord, rail-road car, etc.

For illustrative purposes, some examples of a packaging information system (and/or various components thereof) are discussed below in which particular item package and container parameters are analyzed in particular manners, and in which particular types of analyses and processing of parameters is performed. However, those skilled in the art will appreciate that the techniques described may be used in a wide variety of other situations, and that other implementations are not limited to the details of these examples.

A block diagram of a materials handling facility, which, in one implementation, may be an order fulfillment facility configured to utilize various systems and methods described herein, is illustrated in FIG. 1. In this example, multiple customers 100 may submit orders 120 to one or more of many sellers that utilize the materials handling facility to store, process and/or ship their items. Each order 120 specifies one or more items from inventory 130 to be shipped to the customer or to another entity specified in the order.

A materials handling facility typically includes receiving operations 180 for receiving shipments of stock from various vendors and storing the received stock in inventory 130. To fulfill the orders 120, the one or more items specified in each order may be retrieved or "picked" from inventory 130 (which may also be referred to as stock storage) in the materials handling facility, as indicated by picking operations 140. In some implementations, the items in an order may be divided into multiple item packages (i.e., item packages) for fulfillment by a planning service before item package fulfillment instructions are generated (not shown).

In some implementations, the picking operations 140 may communicate with a central control system, and receive instructions identifying the pack station to which the item(s) of the item package are to be sent for packing. The pack station may be determined based on the size of the container into which the item package is to be packed for shipping and/or based on whether the container is to be sealed with custom branded tape. In some materials handling facilities, not all pack stations have all sizes of containers or all the different custom branded tapes.

In this example, picked items may be delivered to one or more stations in the order fulfillment facility for sorting operations 150 into their respective orders or item packages and then transferred to a designated pack station 160 for packing of the items into containers. The pack station may receive packing instructions identifying the container into which the items of the item package are to be placed for shipping and/or whether the container is to receive custom branded tape. In some implementations, the packing instructions may identify to the tape dispensing device which tape dispenser to use for dispensing tape and/or how much tape to dispense. For example, in some implementations, the tape dispensing device may include multiple tape dispensers, each tape dispenser containing a spool of custom branded tape, each custom brand associated with a different seller. In such an implementation, the packing instructions may identify to the tape dispensing device the tape dispenser to use such that custom branded tape associated with the seller of the item(s) included in the item package is dispensed and used by the packing agent to seal the container into which the item package is placed. In some implementations, the item package may include items from multiple sellers and custom branded tape is to be applied to the container for each seller. In such instances, the packing instructions may identify to the tape dispensing device the tape dispensers to use such that custom branded tape associated with each seller of the item(s) included in the item package is dispensed and used by the packing agent to seal the container into which the item package is placed. For example, if there are two sellers, custom branded tape for one of the sellers may be used to seal the bottom of the container and custom branded tape for the other seller may be used to seal the top of the container. In other implementations, the custom branded tape may be applied to other portions or sections of the container.

In other implementations, the tape dispensing device may include a printer configured to print custom branding onto tape as it is dispensed. In such an implementation, the packing instructions may identify to the tape dispensing device the custom brand(s) that is to be printed onto the tape. For example, if there is one seller of the items in the item package, the packing instructions may identify the custom brand associated with that seller for use in printing the custom brand on the tape as it is dispensed. In other examples, if there are multiple sellers of the items included in the item package, the packing instructions may identify the custom brands for each seller and information as to how the multiple custom brands are to be configured for printing onto the tape as it is dispensed. For example, if there are two sellers of the items included in the item package, the packing instructions may identify the custom brands for each seller and instructions to alternate between the two customer brands for printing onto the tape.

In addition to identifying custom branding to apply to the container, in some implementations, the packing instructions may also identify to the tape dispensing device how much tape to dispense. For example, if the recommended container is 8"×14"×6", the packing instructions may include information identifying that 18" of tape is to be dispensed for sealing the bottom of the container when formed (14" for the base of the container and 2" to extend up either side) and another 18" of tape is to be dispensed for sealing the top of the container after the item package has been placed into the container. In other implementations, the packing agent may determine when and/or how much of the tape to dispense.

Note that not every fulfillment facility may include both sorting and pack stations. In certain implementations, agents may transfer picked items directly to a pack station, while in other implementations agents may transfer picked items to a combination sort and pack station (not illustrated). This may result in a stream and/or batches of picked items for multiple incomplete or complete orders being delivered to a sort station for sorting operations 150 into their respective orders for packing and shipping, according to one implementation. In other implementations, items and/or containers may be routed directly to the shipping operations 170.

Because portions of an order may be received at different times, sorting operations 150 and packing operations 160 may have to wait for one or more items of some orders to be delivered to the sort station(s) before processing of the orders completes.

The package routing operations 165 may, in various implementations, be automated or manual. The package routing operations 165 may communicate with the central control system and receive an indication of a shipping station 170 to which each packed order should be routed for shipping. The shipping operations include placing the containers of packed item packages onto transportation units for delivery from the materials handling facility.

Note that a picked, packed and shipped item package does not necessarily include all of the items ordered by the customer; a shipped item package may include only a subset of the ordered items available to ship at one time from one materials handling facility. Also note that the various operations of a materials handling facility may be located in one building or facility, or alternatively may be spread or subdivided across two or more buildings or facilities.

Note that the arrangement and order of operations illustrated by FIG. 1 is merely one example of many possible implementations of the operations of a materials handling facility. Other types of materials handling, manufacturing, or order fulfillment facilities may include different, fewer, or additional operations and resources, according to different implementations.

The items in a materials handling facility may be of varying shapes, sizes, and weight. For example, some items in a materials handling facility may be irregularly shaped. To facilitate container recommendation and/or more efficient shipping, irregularly shaped items may be handled in boxes or other regularly shaped packaging, which may make stacking of such items possible. In other implementations, irregularly shaped items may be handled without placing them in regularly shaped packaging. According to various implementations, automated product dimension estimation and/or correction may be utilized with any regularly shaped or irregularly shaped items.

Figure 2A:
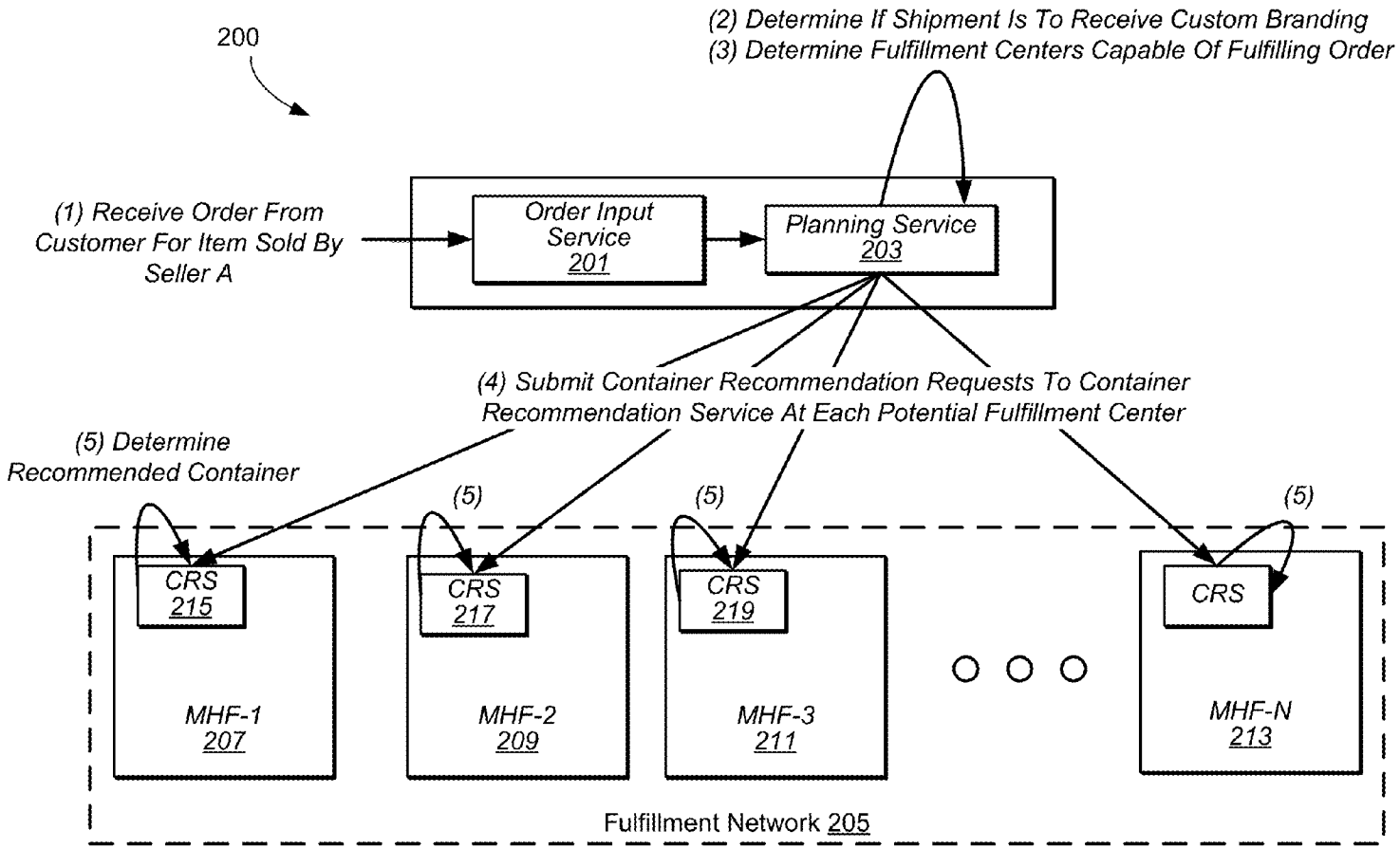
FIGS. 2A-2C illustrate a transition diagram of one implementation of a system configured for routing items to a pack station for packing, according to an implementation.
Figure 2B:
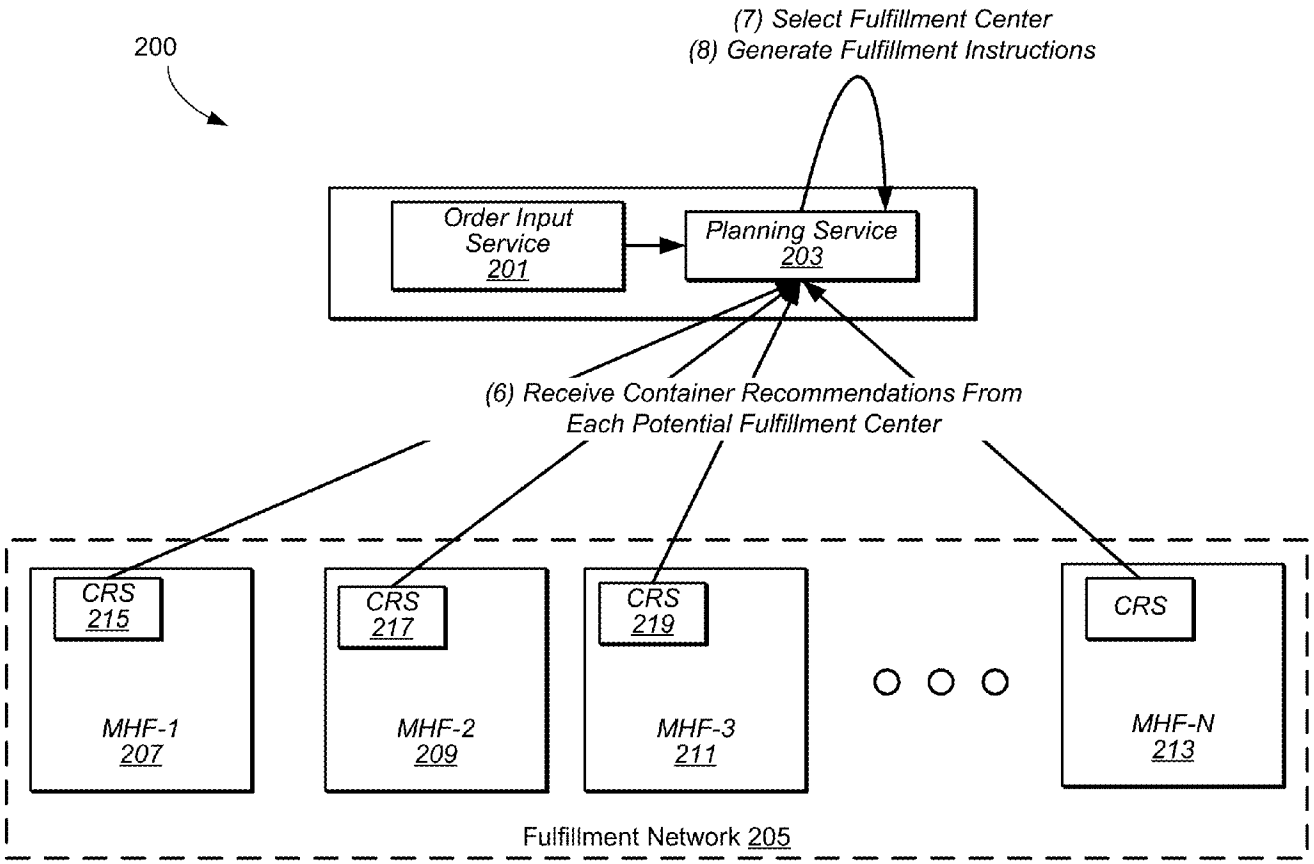
Figure 2C:
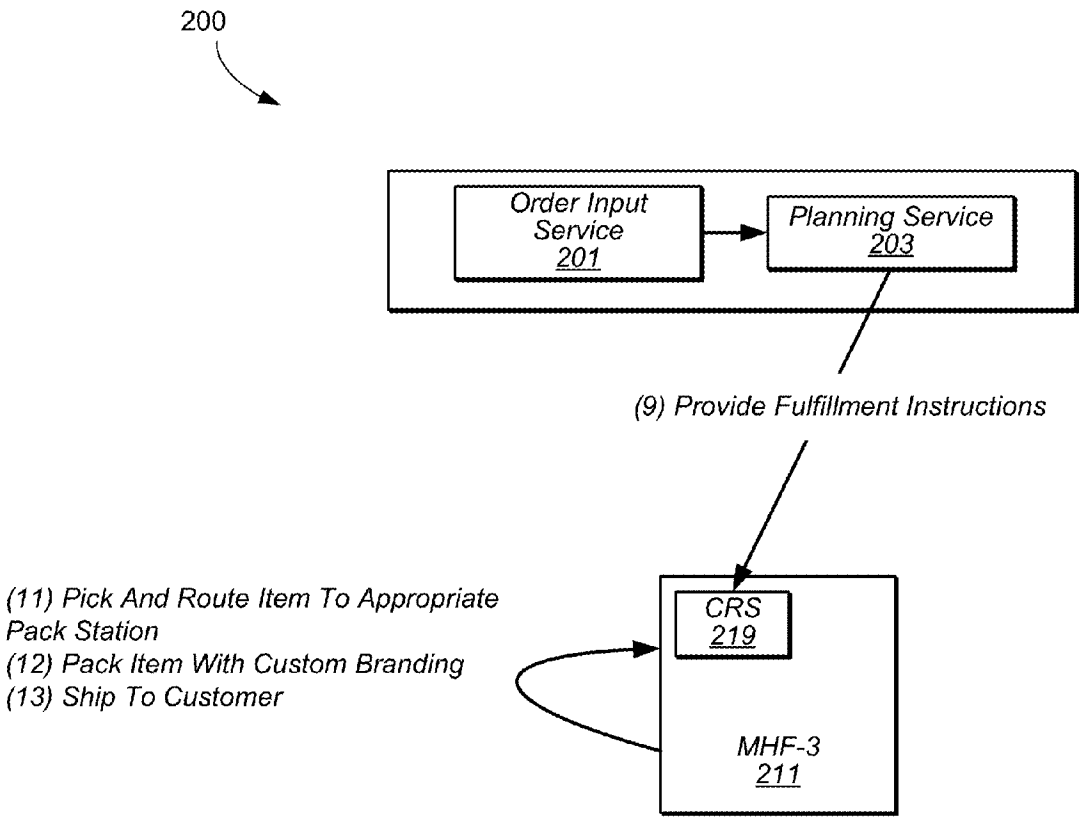

FIGS. 2A-2C illustrate a transition diagram of one implementation of a system configured for routing items to a pack station for packing, according to an implementation. At an initial state, an order for one or more items sold by Seller A is received from a customer. The order may be received from an e-commerce website or via any other means in which the items of the order are to be shipped from a materials handling facility. The order is received by an order input service 201 that determines the seller of the items and information regarding the customer that purchased the items. The order input service 201 coordinates with the planning service 203 and provides this information to the planning service 203.

The planning service 203 receives order information from the order input service 201 identifying the items of the order as well as an identification of the seller of the items. Based the identity of the seller, the planning service 203 may determine whether custom branded tape is to be applied to the container into which the item package is to be packed for shipping. In some implementations, the planning service 203 may also determine whether the items of the order are to be divided into one or more item packages for shipment. In such a case, a determination may be made for each item package as to whether custom branded tape is to be used.

The planning service 203 may also identify which materials handling facilities 207, 209, 211, 213 of a fulfillment network 205 are capable of fulfilling the item package. In some implementations, the fulfillment network 205 may include multiple materials handling facilities and those materials handling facilities may store, process and ship the same and/or different items. Likewise, different materials handling facilities may store, process and ship different items for different sellers. Accordingly, for a particular item package, not every materials handling facility of the fulfillment network 205 may be capable of shipping the item package—e.g., it may not maintain the ordered items and/or may not have custom branding requested by the seller.

Based on a determination of which materials handling facilities of the fulfillment network 205 are capable of shipping the item package, the planning service 203 may submit a container recommendation request to each potential materials handling facility. For example, the planning service 203 may submit container recommendation requests to container recommendation services 215, 217, 219 at each materials handling facility 207, 209, 211, 213 requesting that the container recommendation service recommend a container that would be used at the materials handling facility to package and ship the item package. Different materials handling facilities, 207, 209, 211, 213 may maintain different sizes of containers and thus may recommended different containers for use in shipping the item package. However, in some implementations, if common sized containers are maintained at two or more of the materials handling facilities, a single container recommendation service may be used to recommend a container for packaging the item package.

Each container recommendation service that receives the container recommendation request from the planning service 203 may identify a recommend container for use in packaging the item for shipment. The container recommendation service may recommend a container based on the containers available at the corresponding materials handling facility and based on the dimensions of the items of the item package. In some implementations, the planning service and/or the materials handling facilities may maintain item dimension information for each item of inventory. Such information may be used to determine and recommend a container into which the item should be packed for shipping. In other implementations, a product dimension estimator may be used to determine sizes of items of an item package.

In some implementations, the container recommendation service at each materials handling facility may also consider the sizes of containers available at pack stations that contain or have the ability to generate custom branded tape for the seller of the item package. Some pack stations within a materials handling facility may have different sizes of containers and/or have different spools of custom branded tape.

Upon determining the recommended container, each container recommendation service returns an identification of the recommended container to the planning service 203. Once each potential materials handling facility has responded, the planning service 203 may select a materials handling facility that will be used to ship the item package. Various factors may be considered when selecting a materials handling facility. For example, the planning service 203 may determine, based on the distance of the materials handling facility to the delivery destination, the size of the recommended container and/or the weight of the item package, the estimated shipping costs for shipping the item from each potential materials handling facility. Based on the determined estimated shipping costs, the materials handling facility with the lowest estimated shipping cost may be selected. In other implementations, the planning service may also consider other factors, such as quantity of items available at each materials handling facility.

Upon selecting a materials handling facility, the planning service 203 may generate fulfillment instructions that are delivered to the selected materials handling facility. The fulfillment instructions may include information necessary for fulfilling the item package. For example, the fulfillment instructions may identify the items of the item package, the delivery method, the destination delivery address, the promised delivery date, the identification of the seller(s), whether the item package is to receive custom branded tape when sealing the container, the type of tape to use (e.g., standard tape, heavy duty tape, perforated tape) an identification of the custom brand to be used, etc. The fulfillment instructions are delivered to the selected materials handling facility.

The materials handling facility 211 selected for fulfilling the item package, upon receiving fulfillment instructions, may initiate picking and routing of the item package to a pack station. In some implementations, the container recommendation service may again recommend a container for use in packaging the item package and/or identify a pack station that is to receive and pack the item package. If a particular pack station is selected, picking instructions may include information identifying the pack station to which the picked items are to be delivered.

In addition, packing instructions may be generated and delivered to the appropriate pack station within the materials handling facility. The packing instructions may identify the recommended container, the tape dispenser to be activated when dispensing tape for sealing the container, the amount of tape to dispense, the type of tape to dispense, the configuration into which the items are to be placed in the container, etc. When an agent scans an item from the item package, the packing instructions may be used to inform both the packing agent and the tape dispensing device as to how the item package is to be packed. For example, if the item package is to be packed such that the container is to be sealed with custom branded tape, the packing instructions may instruct the tape dispensing device to dispense tape from the dispenser that contains the tape with the appropriate custom brand.

Once the items are packed in a container and optionally sealed with the appropriate custom branded tape, the packed item package is transitioned to shipping for shipment to the customer.

Figure 3:
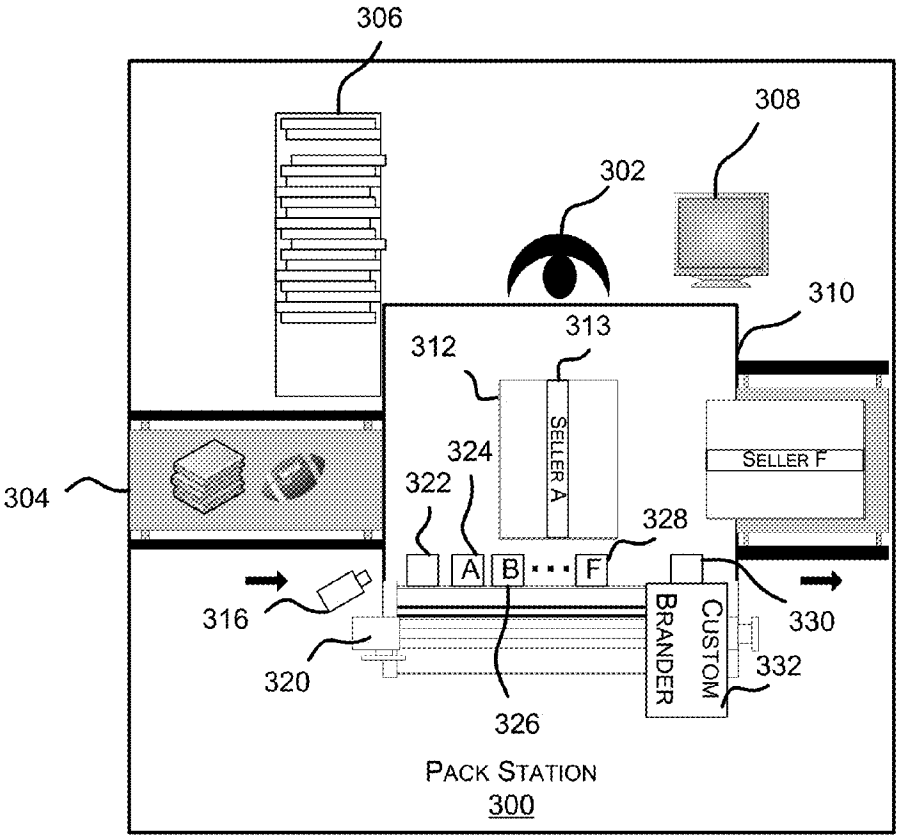
FIG. 3 illustrates a broad view of a pack station within a materials handling facility, according to an implementation.

FIG. 3 illustrates a partial view of a pack station 300 that may be utilized as part of the packing operation 160 (FIG. 1), in accordance with an implementation. The pack station 300 allows at least one packer 302 to receive packing instructions for packing item packages into a container for shipment. The items of an item package may be received at the pack station 300 in a variety of fashions. For example, items of an item package may be received on a conveyer, such as inbound conveyer 304, arrive manually from a picker, arrive in a tote, cart, or by other automated or mechanical means. Once all items of the item package arrive, the packer 302 may select a container from the container stack 306 into which the items may be placed for shipping. In some implementations, the packer 302 may receive information regarding an item package and/or a recommended container via an output, such as a display 308. The display 308, may identify to the packer 302 the items of the item package that are to be included in a container as well as the recommended container into which items of the item package are to be packed. In some implementations, for an item package with multiple items, the display 308 may also present to the packer 302 the configuration as to how the items of the item package are to be placed into the container for packing.

Based on the information provided to the packer 302, the packer 302 may retrieve the recommended container from the container stack 306 and place it on the pack table 310 for packing. Once all the items of the item package 314 have been placed into the container 312, the container 312 may be sealed. For example, as illustrated in FIG. 3, the packer 302 has placed container 312 on the pack table 310, filled it with items of the item package and sealed the container 312 with custom branded tape 313 associated with Seller A.

In addition to providing instructions to the packer 302, the packing instructions may provide information to a tape dispensing device 320 identifying which tape dispenser 322, 324, 326, 328, 330 to use when dispensing tape for use in sealing the container 312. In this example, the container 312 was sealed with custom branded tape associated with Seller A. Accordingly, the packing instructions may instruct the tape dispensing device 320 to dispense tape from tape dispenser 324 because tape dispenser 324 contains pre-printed custom branded tape associated with Seller A. In implementations, if different pieces of custom branded tape are to be dispensed, for example for Seller A and Seller B, the packing instruction may instruct the tape dispensing device 320 to dispense tape from tape dispenser 324 and 326 because tape dispenser 324 contains pre-printed custom branded tape associated with Seller A and tape dispenser 326 contains pre-printed custom branded tape associated with Seller B.

The tape dispensing device 320 may be configured to have multiple different tape dispensers, each dispenser containing spools of tape that may be dispensed and used for sealing a container. While the example illustrated in FIG. 3 includes a tape dispensing device with five tape dispensers, in other implementations, the tape dispenser may have fewer or more tape dispensers.

In some implementations, each tape dispenser 322, 324, 326, 328, 330 may contain a spool of tape with different custom branding. Likewise, one or more of the tape dispensers, such as tape dispenser 320, may include a spool with standard tape. Standard tape may be, for example, tape that does not have any branding (e.g., clear tape) or tape that has a standard brand that is used on any container for which custom branding has not been requested. In some implementations, the tape dispensers may include different types of type, either custom branded or not custom branded. For example, one of the tape dispensers may include custom branded tape on a standard strength tape dispenser while another may include a stronger strength tape dispenser or perforated tape. In some implementations, the tape dispensing device 320 may also be configured to include a printer or other custom brander, such as printer 332. The printer may receive an identification of a custom brand, such as the sellers name (e.g., Seller A) and/or a logo associated with the seller, and print the custom brand on the tape as or just prior to it being dispensed. In such an implementation, the tape dispensing device 320 may or may not have other tape dispensers as the printer may be capable of printing any custom brand onto the tape as it is dispensed.

In addition to the packing instructions identifying to the tape dispensing device 320 which tape dispenser to use when dispensing tape, in some implementations, the packing instructions may also identify how much of the tape is to be dispensed for use in sealing the container. For example, if a recommended container has dimensions of 5"×8"×3", the packing instruction may include information instructing the tape dispensing device to dispense 12" of tape for use in sealing the bottom of the container and 12" of tape for use in sealing the top of the container.

If the packer 302 does not use the recommended container, the packer 302 may modify the instructions to either reduce or increase the amount of tape dispensed and/or the packer may dispense a desired amount of tape. In some implementations, the pack station 300 may include an input device 334, such as a camera, that may be used to determine, prior to dispensing the tape, whether the recommended container is being used and/or when to dispense the tape. If it is determined that the recommended container is not being used, the size of the actual container may be determined and the amount of dispensed tape adjusted. Likewise, the input device may monitor and provide dispensing instructions when the packer is ready for the tape. For example, images may be captured of the pack station and a determination may be made as to when the container has been formed such that the bottom is ready for sealing. Any variety of image processing techniques may be used. For example, image processing may be used to determine when a rectangular shape of the appropriate dimensions are present on the pack station (e.g., the container has been formed). Once the container is formed, the determined amount of tape may be dispensed for use by the packer in sealing the bottom of the container. In other implementations, the tape dispensing device may include an actuator that can be activated by the packer to dispense the tape.

In a similar fashion, images may be captured and processed to determine when all of the items of the item package have been placed into the container. Once all items are in the container, instructions to dispense the determined amount of tape from a specific tape dispenser may be provided to the tape dispending device 320.

In some implementations, a single image capture device 316 may be positioned directly above the pack table such that a container 312 can be imaged as it is being packed for shipment and/or to determine if the recommended container has been used to pack the item package. In other implementations, a single image capture device may be offset to the side or at another location to capture the image of the container. In other implementations, multiple image capture devices 316 may be positioned at, around or above the pack table 310 so that multiple images of the container 312 can be captured and analyzed. Using multiple image capture devices 316, a stereo image or other three dimensional image of the container can be rendered and used for analysis to determine if the recommended container is being used and/or to determine when all of the items of the item package have been placed into the container.

Figure 4:
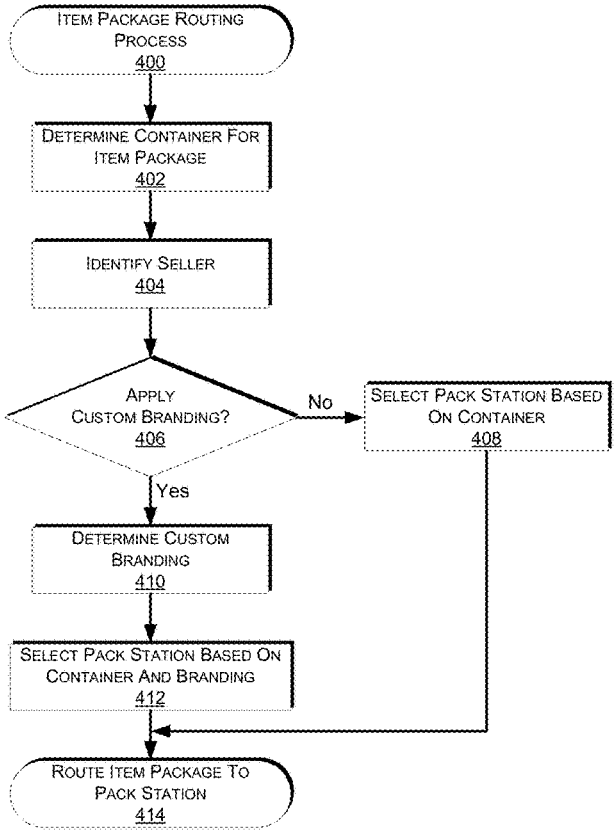
FIG. 4 is a flow diagram illustrating an example process for routing an item package to a pack station, according to an implementation.

FIG. 4 is a flow diagram illustrating an example process 400 for routing an item package to a pack station, according to an implementation. This process, and each process described herein, may be implemented by the architectures described herein or by other architectures. The process is illustrated as a collection of blocks in a logical flow graph. Some of the blocks represent operations that can be implemented in hardware, software, or a combination thereof. In the context of software, the blocks represent computer-executable instructions stored on one or more computer readable media that, when executed by one or more processors, perform the recited operations. Generally, computer-executable instructions include routines, programs, objects, components, data structures, and the like that perform particular functions or implement particular abstract data types.

The computer readable media may include non-transitory computer readable storage media, which may include hard drives, floppy diskettes, optical disks, CD-ROMs, DVDs, read-only memories (ROMs), random access memories (RAMs), EPROMs, EEPROMs, flash memory, magnetic or optical cards, solid-state memory devices, or other types of storage media suitable for storing electronic instructions. In addition, in some implementations the computer readable media may include a transitory computer readable signal (in compressed or uncompressed form). Examples of computer readable signals, whether modulated using a carrier or not, include, but are not limited to, signals that a computer system hosting or running a computer program can be configured to access, including signals downloaded through the Internet or other networks. Finally, the order in which the operations are described is not intended to be construed as a limitation, and any number of the described operations can be combined in any order and/or in parallel to implement the process.

The example process 400 begins by determining the recommended container for use in packing the item package, as in 402. As discussed above, the recommended container may be determined by the container recommendation service at the materials handling facility based on, for example, the size of the item package and/or the containers available at the materials handling facility. In addition to determining the recommended container, the seller of the items included in the item package is identified, as in 404.

Based on the identity of the seller, a determination may be made as to whether custom branding, such as custom branded tape, is to be applied to the container in which the item package will be packed, as in 406. Custom branded tape may be specified and paid for by the seller, selected by the customer, determined based on the items of the item package, etc. For example, in a multi-seller materials handling facility, a seller may specify that they desire to have custom branded tape used to seal containers that contain items they sell. The seller may provide the custom branding they desire and pay to have the custom branding applied.

In another implementation, the customer may select to have custom branding applied to the container. For example, if Adam is buying a gift for Eve, Adam may select to have a custom branded message, such as "Happy Birthday, Eve!", applied to container. As still another example, some items may require custom branding to ensure safe delivery. For example, if the item package includes fragile items, the tape may receive a custom brand of "Fragile" or "Do Not Cut". In some implementations, custom branded tape may have a combination of custom brands. For example, a custom branded tape may include custom branding from both the seller and the customer (e.g., "Happy Birthday, Eve!: Seller A"), from multiple sellers if the item package includes items purchased from more than one seller (e.g., "Seller A: Seller B"), or any combination thereof. As will be appreciated, any form and/or amount of custom brand may be applied to the tape used to seal containers. The custom brand may include text, graphics, logos, images, and/or any other form of visual content. In some implementations, the custom brand may also identify the type of tape and/or shape of tape to dispense. For example, standard tape may be used for sealing containers of a particular weight. Likewise, heavy duty tape may be used to seal containers with heavier items.

Returning to FIG. 4, if it is determined that custom branding is not to be applied, a pack station is selected based on the size of the recommended container, as in 408. As noted above, not all pack stations within a materials handling facility may contain all sizes of containers. Accordingly, a pack station with the recommended container size may be selected. However, if it is determined at decision block 406 that custom branding is to be applied, the custom branding is determined, as in 410. As noted above, the custom branding may be provided by the seller, customer and/or based on the items of the item package. In some implementations, the custom branding may be identified in the fulfillment instructions received from the shipment planning service.

Based on the custom branded tape to be applied and/or based on the size of the recommended container, a pack station is selected, as in 412. Similar to selecting a pack station based on the size of the recommended container, in some materials handling facilities, not all pack stations have the same custom branded tape and/or do not have the ability to print custom brands on tape as it is dispensed. As will be appreciated, in selecting a pack station additional considerations beyond the container size and custom branding may be considered. For example, the current or anticipated load on the pack station may be considered as a factor in selecting a pack station.

Upon selection of a pack station at either block 408 or 412, the item package is routed to the selected pack station for packing, as in 414. In addition, packing instructions identifying the container and/or custom branding to be used may also be provided to the selected pack station.

Figure 5:
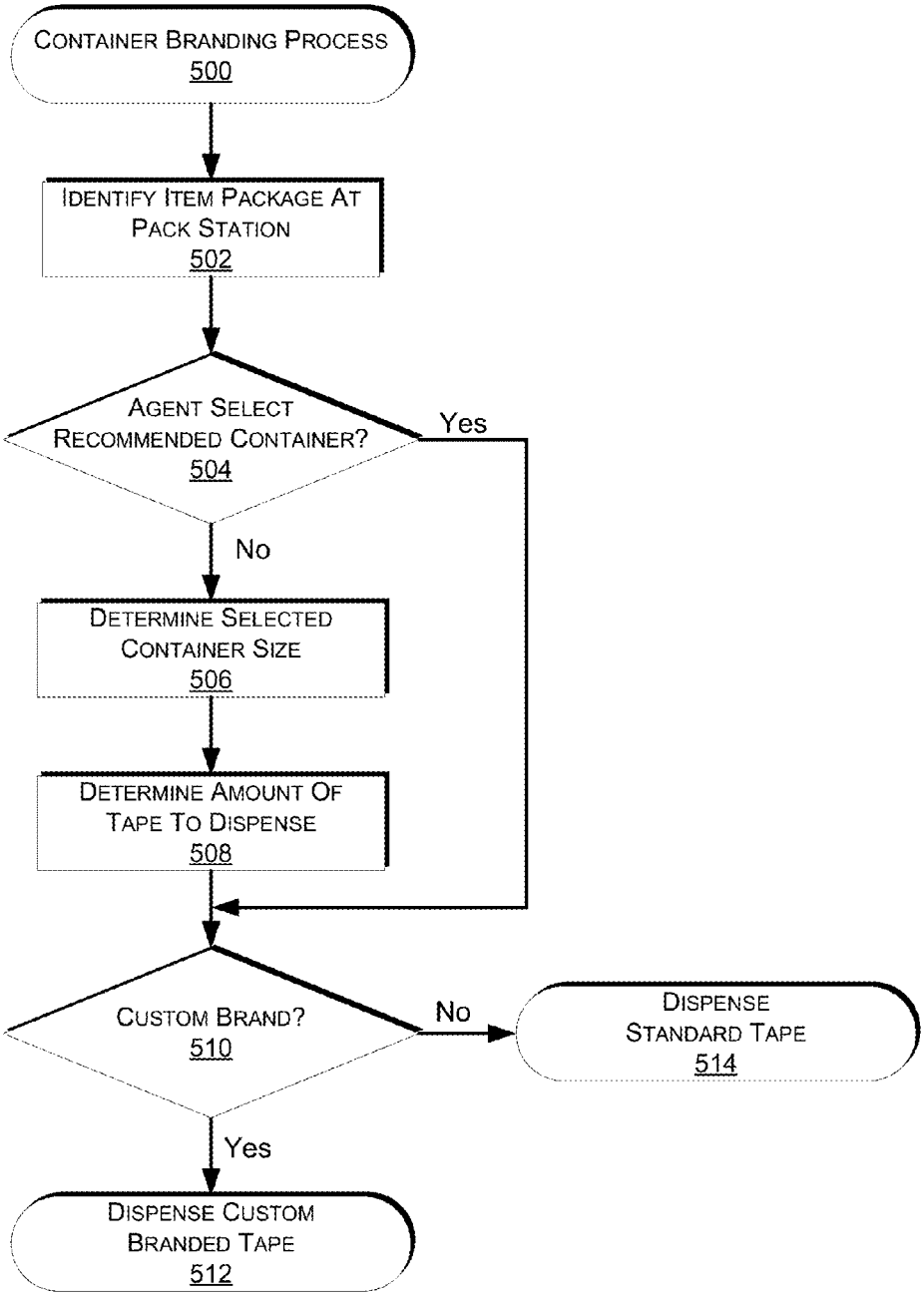
FIG. 5 is a flow diagram illustrating an example process for providing instructions to a pack station for packing a container, according to an implementation.

FIG. 5 is a flow diagram illustrating an example process 500 for providing instructions to a pack station for packing a container, according to an implementation. The example process 500 begins by identifying an item package at a pack station, as in 502. An item package may be identified at a pack station, for example, when an agent scans an item of the item package. The item may be associated with the item package and when scanned the packing instructions may be retrieved for use in packing the item package. In addition to identifying an item package at the pack station, a determination may be made as to whether the packing agent selected and is using the recommended container, as in 504. In some implementations, it may be assumed that the agent is using the recommended container unless the agent provides a notification that a different container is being used. In other implementations, the pack station may include one or more imaging devices that capture images of the container as it is selected by the agent and placed onto the pack station. Those images may be analyzed to determine if the selected container corresponds with the recommended container.

If it is determined that the agent is not using the recommended container to pack the item package, the size of the selected container is determined, as in 506. In some implementations, if the agent selects a different container, the agent may provide an identification of the actually selected container. In other implementations, the captured images of the selected container may be analyzed to determine the size of the actual container. For example, a container identifier printed on the container may be identified using image and/or character recognition and the size of the container determined from the container identifier. In other examples, the size of the container may be determined based on a measurement of the container determined from the captured images.

Based on the size of the actually selected container, an amount of tape and/or the type of tape to dispense is determined, as in 508. In some implementations, the amount and/or type of tape to dispense may be a factor of the overall length of the container plus an extra amount to secure the bottom length to the sides. For example, if the container has a length of 16 inches, the amount of tape to dispense may be 20 inches (16 inches for the length, plus 2 inches to secure each end of the tape to the side of the container). Likewise, an amount of tape to dispense to secure the top of the container may also be determined. In some implementations, additional tape for securing other sections of the container may also be determined. The type (e.g., strength) of tape may be determined based on, for example, the weight of the container within the included item packages.

Upon determining the amount and/or type of tape to dispense if the recommended container is not used (block 508) or if it is determined that the recommended container is being used, a determination is made as to whether custom branded tape is to be dispensed for use in securing the container, as in 510. As noted above, custom branding may be identified in the packing instructions. If custom branding is to be applied, the determined amount of tape with the custom brand is dispensed, as in 512. As discussed above, in some implementations, the tape dispensing device may include multiple tape dispensers, each dispenser containing a different spool of custom branded tape and/or type of tape. In such an implementation, determining the custom branded tape may include identifying which tape dispenser to activate to dispense the appropriate custom branded tape. In other implementations, the tape dispensing device may include a printer configured to print a custom brand onto the tape as, or just before, it is dispensed. In such an example, the custom brand that is to be included on the tape may be identified in the packing instructions and provided to the tape dispensing device. Likewise, the type of tape that is to be used may be included in the packing instructions.

If it is determined at decision block 510 that custom branding is not to be applied, an appropriate amount of standard tape is dispensed, as in 514. Standard tape may be clear (or any other color) tape. Alternatively, standard tape may include other advertisements not related to the seller, customer and/or materials handling facility. In still other examples, standard tape may include a brand and/or logo of the materials handling facility.

Various operations of a packaging information system, such as those described herein, may be executed on one or more computer systems, interacting with various other devices in a materials handling facility, according to various implementations. One such computer system is illustrated by the block diagram in FIG. 6. In the illustrated implementation, a computer system 600 includes one or more processors 610A, 610B through 610N, coupled to a non-transitory computer-readable storage medium 620 via an input/output (I/O) interface 630. The computer system 600 further includes a network interface 640 coupled to an I/O interface 630, and one or more input/output devices 650. In some implementations, it is contemplated that a packaging information system may be implemented using a single instance of the computer system 600, while in other implementations, multiple such systems or multiple nodes making up the computer system 600 may be configured to host different portions or instances of a packaging information system. For example, in one implementation, some data sources or services (e.g., capturing actual container information) may be implemented via one or more nodes of the computer system 600 that are distinct from those nodes implementing other data sources or services (e.g., recommending a container for an item package). In some implementations, a given node may implement the functionality of more than one component of a packaging information system.

In various implementations, the computer system 600 may be a uniprocessor system including one processor 610A, or a multiprocessor system including several processors 610A-610N (e.g., two, four, eight, or another suitable number). The processors 610A-610N may be any suitable processor capable of executing instructions. For example, in various implementations the processors 610A 610N may be general-purpose or embedded processors implementing any of a variety of instruction set architectures (ISAs), such as the x86, PowerPC, SPARC, or MIPS ISAs, or any other suitable ISA. In multiprocessor systems, each of the processors 610A-610N may commonly, but not necessarily, implement the same ISA.

The non-transitory computer-readable storage medium 620 may be configured to store executable instructions and/or data accessible by the one or more processors 610A-610N. In various implementations, the non-transitory computer-readable storage medium 620 may be implemented using any suitable memory technology, such as static random access memory (SRAM), synchronous dynamic RAM (SDRAM), nonvolatile/Flash-type memory, or any other type of memory. In the illustrated implementation, program instructions and data implementing desired functions, such as those described above, are shown stored within the non-transitory computer-readable storage medium 620 as program instructions 625 and data storage 635, respectively. In other implementations, program instructions and/or data may be received, sent or stored upon different types of computer-accessible media, such as non-transitory media, or on similar media separate from the non-transitory computer-readable storage medium 620 or the computer system 600. Generally speaking, a non-transitory, computer-readable storage medium may include storage media or memory media such as magnetic or optical media, e.g., disk or CD/DVD-ROM coupled to the computer system 600 via the I/O interface 630. Program instructions and data stored via a non-transitory computer-readable medium may be transmitted by transmission media or signals such as electrical, electromagnetic, or digital signals, which may be conveyed via a communication medium such as a network and/or a wireless link, such as may be implemented via the network interface 640.

In one implementation, the I/O interface 630 may be configured to coordinate I/O traffic between the processors 610A-610N, the non-transitory computer-readable storage medium 620, and any peripheral devices in the device, including the network interface 640 or other peripheral interfaces, such as input/output devices 650. In some implementations, the I/O interface 630 may perform any necessary protocol, timing or other data transformations to convert data signals from one component (e.g., non-transitory computer-readable storage medium 620) into a format suitable for use by another component (e.g., processors 610A-610N). In some implementations, the I/O interface 630 may include support for devices attached through various types of peripheral buses, such as a variant of the Peripheral Component Interconnect (PCI) bus standard or the Universal Serial Bus (USB) standard, for example. In some implementations, the function of the I/O interface 630 may be split into two or more separate components, such as a north bridge and a south bridge, for example. Also, in some implementations, some or all of the functionality of the I/O interface 630, such as an interface to the non-transitory computer-readable storage medium 620, may be incorporated directly into the processors 610A-610N.

The network interface 640 may be configured to allow data to be exchanged between the computer system 600 and other devices attached to a network, such as other computer systems, or between nodes of the computer system 600. In various implementations, the network interface 640 may support communication via wired or wireless general data networks, such as any suitable type of Ethernet network. For example, the network interface 640 may support communication via telecommunications/telephony networks such as analog voice networks or digital fiber communications networks, via storage area networks such as Fibre Channel SANs, or via any other suitable type of network and/or protocol.

Input/output devices 650 may, in some implementations, include one or more displays, projection devices, audio output devices, keyboards, keypads, touchpads, scanning devices, voice or optical recognition devices, or any other devices suitable for entering or retrieving data by one or more computer systems 600. Multiple input/output devices 650 may be present in the computer system 600 or may be distributed on various nodes of the computer system 600. In some implementations, similar input/output devices may be separate from the computer system 600 and may interact with one or more nodes of the computer system 600 through a wired or wireless connection, such as over the network interface 640.

Figure 6:
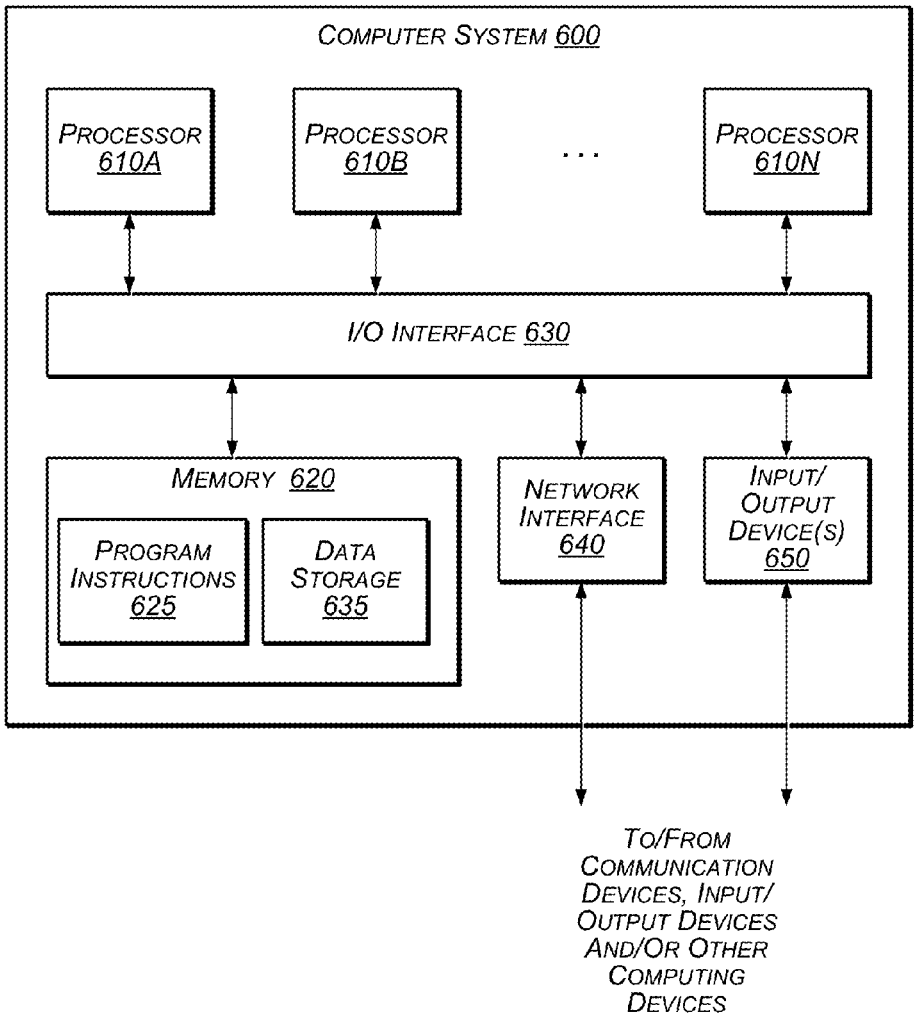
FIG. 6 is a block diagram illustrating an example computer system configured to implement one or more of the operations described herein.

As shown in FIG. 6, the computer readable storage medium 620 may include program instructions 625 which may be configured to implement a packaging information system and data storage 635, which may comprise various tables, databases and/or other data structures accessible by the program instructions 625. In one implementation, the program instructions 625 may include various software modules configured to implement a planning service, a container recommendation service and/or a custom branding service. The data storage 635 may include various data stores for maintaining one or more protected item lists, data representing physical characteristics of items and/or other item parameter values, container parameter values, item package information, custom brands, actual or expected shipping costs, avoidable shipping costs, package performance reports, etc. The data storage 635 may also include one or more data stores for maintaining data representing delivery related feedback, such as customer ratings, experiences and the like.

In various implementations, the parameter values and other data illustrated herein as being included in one or more data stores may be combined with other information not described or may be partitioned differently into more, fewer, or different data structures. In some implementations, data stores used in a packaging information system, or in components or portions thereof, may be physically located in one memory or may be distributed among two or more memories. These memories may be part of a single computer system or they may be distributed among two or more computer systems, such as two computer systems connected by a wired or wireless local area network, or through the Internet, in different implementations. Similarly, in other implementations, different software modules and data stores may make up a packaging information system and/or any of the various components thereof described herein.

Users may interact with the packaging information system (and/or various components thereof) in various ways in different implementations, such as to select and/or dispense a custom brand, dispense additional tape, select a container other than the recommended container, etc. For example, some users may have physical access to the computing system 600, and if so, may interact with various input/output devices 650 to provide and/or receive information. Alternatively, other users may use client computing systems to access the packaging information system and/or its constituent components, such as remotely via the network interface 640 (e.g., via the Internet and/or the World Wide Web). In addition, some or all of the packaging information system components may provide various feedback or other general types of information to users (e.g., in response to user requests) via one or more input/output devices 650.

Those skilled in the art will appreciate that the computing system 600 is merely illustrative and is not intended to limit the scope of implementations. In particular, the computing system and devices may include any combination of hardware or software that can perform the indicated functions, including computers, network devices, internet appliances, PDAs, wireless phones, pagers, etc. The computing system 600 may also be connected to other devices that are not illustrated, or instead may operate as a stand-alone system. In addition, the functionality provided by the illustrated components may in some implementations be combined in fewer components or distributed in additional components. Similarly, in some implementations the functionality of some of the illustrated components may not be provided and/or other additional functionality may be available.

Those skilled in the art will also appreciate that, while various items are illustrated as being stored in memory or storage while being used, these items or portions of them may be transferred between memory and other storage devices for purposes of memory management and data integrity. Alternatively, in other implementations, some or all of the software components may execute in memory on another device and communicate with the illustrated computing system via inter-computer communication. Some or all of the system components or data structures may also be stored (e.g., as instructions or structured data) on a non-transitory, computer-accessible medium or a portable article to be read by an appropriate drive, various examples of which are described above. In some implementations, instructions stored on a computer-accessible medium separate from computer system 600 may be transmitted to computer system 600 via transmission media or signals such as electrical, electromagnetic, or digital signals, conveyed via a communication medium such as a network and/or a wireless link. Various implementations may further include receiving, sending or storing instructions and/or data implemented in accordance with the foregoing description upon a computer-accessible medium. Accordingly, the techniques described herein may be practiced with other computer system configurations.

Those skilled in the art will appreciate that in some implementations the functionality provided by the methods and systems discussed above may be provided in alternative ways, such as being split among more software modules or routines or consolidated into fewer modules or routines. Similarly, in some implementations, illustrated methods and systems may provide more or less functionality than is described, such as when other illustrated methods instead lack or include such functionality respectively, or when the amount of functionality that is provided is altered. In addition, while various operations may be illustrated as being performed in a particular manner (e.g., in serial or in parallel) and/or in a particular order, those skilled in the art will appreciate that in other implementations the operations may be performed in other orders and in other manners. Those skilled in the art will also appreciate that the data structures discussed above may be structured in different manners, such as by having a single data structure split into multiple data structures or by having multiple data structures consolidated into a single data structure. Similarly, in some implementations, illustrated data structures may store more or less information than is described, such as when other illustrated data structures instead lack or include such information respectively, or when the amount or types of information that is stored is altered. The various methods and systems as illustrated in the figures and described herein represent example implementations. The methods and systems may be implemented in software, hardware, or a combination thereof in other implementations. Similarly, the order of any method may be changed and various elements may be added, reordered, combined, omitted, modified, etc., in other implementations.

From the foregoing, it will be appreciated that, although specific implementations have been described herein for purposes of illustration, various modifications may be made without deviating from the spirit and scope of the appended claims and the elements recited therein. In addition, while certain aspects are presented below in certain claim forms, the inventors contemplate the various aspects in any available claim form. For example, while only some aspects may currently be recited as being embodied in a computer-readable storage medium, other aspects may likewise be so embodied. Various modifications and changes may be made as would be obvious to a person skilled in the art having the benefit of this disclosure. It is intended to embrace all such modifications and changes and, accordingly, the above description to be regarded in an illustrative rather than a restrictive sense.

What is claimed is:

1. A computer implemented method for dispensing tape, comprising:

under control of one or more computing systems configured with executable instructions, receiving an order for an item to be shipped from a materials handling facility, wherein the materials handling facility ships items for a plurality of sellers;

identifying a seller of the plurality of sellers associated with the item;

determining that containers shipped from the materials handling facility for the seller are to receive a custom branded tape associated with the seller; and generating fulfillment instructions for fulfilling the order from the materials handling facility, wherein the fulfillment instructions include:

routing instructions for routing the item to a pack station within the materials handling facility having a tape dispensing device configured to dispense the custom branded tape; and tape dispensing instructions identifying a length of the custom branded tape to dispense from the tape dispensing device;

wherein the tape dispensing device is capable of dispensing a plurality of different custom branded tapes, each custom branded tape associated with a different seller.

2. The computer implemented method of claim 1, wherein the custom branded tape includes at least one of a name of the seller, a logo of the seller, information about the order, a delivery address for the order, or a warning.

3. The computer implemented method of claim 1, wherein the tape dispensing device includes a plurality of tape dispensers, wherein at least one of the tape dispensers is configured to dispense custom branded tape with custom branding associated with a seller.

4. The computer implemented method of claim 1, wherein:

the tape dispensing device includes a first tape dispenser that contains a first roll of tape that is pre-printed with a first custom brand for a first seller; and the tape dispensing device includes a second tape dispenser that contains a second roll of tape that is pre-printed with a second custom brand for a second seller.

5. The computer implemented method of claim 4, wherein the tape dispensing device includes a third tape dispenser that contains a third roll of tape that is not pre-printed.

6. The computer implemented method of claim 1, further comprising:

determining a recommended container into which the item is to be packaged for shipment; and subsequent to a selection of a selected container, capturing at least one image of the selected container.

7. The computer implemented method of claim 6, further comprising:

analyzing the at least one image of the selected container; and determining based at least in part on the analysis of the at least one image that the selected container corresponds with the recommended container.

8. The computer implemented method of claim 6, further comprising:

analyzing the at least one image of the selected container;

determining based at least in part on the analysis of the at least one image that the selected container does not correspond with the recommended container;

determine a size of the selected container based at least in part on the analysis of the at least one image of the selected container; and determining tape dispensing instructions based at least in part on the size of the selected container.

9. A non-transitory computer-readable storage medium storing instructions for fulfilling orders from a materials handling facility, the instructions when executed by a processor causing the processor to at least:

receive an order for an item to be shipped from the materials handling facility, wherein the materials handling facility ships items for a plurality of sellers;

determine that tape having a custom brand is to be applied to a container in which the item will be shipped; and generate fulfillment instructions for fulfilling the order from the materials handling facility, wherein the fulfillment instructions include:

routing instruction for routing the item to a pack station within the materials handling facility having a tape dispensing device configured to dispense the tape having the custom brand; and tape dispensing instructions identifying the custom brand to be dispensed from the tape dispensing device;

wherein the tape dispensing device is capable of dispensing tape having different custom brands.

10. The non-transitory computer-readable storage medium of claim 9, wherein the tape dispensing device includes a printer configured to print the custom brand on a tape.

11. The non-transitory computer-readable storage medium of claim 9, the instructions when executed by the processor further causing the processor to at least:

determine a recommended container into which the item is to be packaged for shipment.

12. The non-transitory computer-readable storage medium of claim 11, wherein the fulfillment instructions further include an identification of the recommended container.

13. The non-transitory computer-readable storage medium of claim 9, wherein the tape dispensing device includes a plurality of tape dispensers, at least one of the plurality of tape dispensers containing a tape having a custom brand.

14. The non-transitory computer-readable storage medium of claim 9, wherein the custom brand is selected by a customer.

15. The non-transitory computer-readable storage medium of claim 9, wherein the tape dispensing device includes a plurality of tape dispensers, at least one of the plurality of tape dispensers containing a type of tape, wherein the type of tape is at least one of a standard strength tape, a heavy tape or a perforated tape.

16. A computing system, comprising:

one or more processors; and a memory coupled to the one or more processors and storing program instructions that when executed by the one or more processors cause the one or more processors to at least:

identify an item of an item package at a pack station;

determine that an agent selected a recommended container;

determine that a tape with a custom brand associated with a first seller of a plurality of sellers is to be applied to the recommended container; and dispense from a tape dispensing device a length of the tape with the custom brand associated with the first seller, wherein the tape dispensing device is configured to dispense tape having a different custom brand for each of the plurality of sellers.

17. The computing system of claim 16, wherein the item package is identified at least in part in response to the agent scanning the item.

18. The computing system of claim 16, wherein each custom brand is pre-printed on a different roll of tape.

19. The computing system of claim 16, wherein the program instructions that when executed by the processors further cause the processors to at least:

identify a second item package at the pack station;

determine that a tape without a custom brand is to be applied to the recommended container; and dispense from the tape dispensing device a second length of the tape without the custom brand.

20. The computing system of claim 19, wherein the tape without the custom brand is a clear tape.

21. The computing system of claim 16, wherein the tape with the custom brand associated with the first seller further includes a custom brand provided by a customer.

* * * * *